US006587642B1

(12) United States Patent
King

(10) Patent No.: US 6,587,642 B1
(45) Date of Patent: Jul. 1, 2003

(54) CEILING FAN COOLING SYSTEM

(76) Inventor: Daniel King, 13595 S. 2080 West, Riverton, UT (US) 84065

( * ) Notice: Subject to any disclaimer, the term of this patent is extended or adjusted under 35 U.S.C. 154(b) by 0 days.

(21) Appl. No.: 09/712,469

(22) Filed: Nov. 14, 2000

(51) Int. Cl.[7] ..... F24H 3/02
(52) U.S. Cl. ..... 392/364
(58) Field of Search ..... 392/364, 347, 392/360, 361; 454/252, 228, 229, 233; 62/259.1, 239, 244

(56) References Cited

U.S. PATENT DOCUMENTS

| | | | | |
|---|---|---|---|---|
| 2,638,757 A | | 5/1953 | Borgerd | |
| 2,682,757 A | | 7/1954 | Borgerd | |
| 4,508,958 A | | 4/1985 | Kan et al. | |
| 4,702,087 A | | 10/1987 | Nakajima et al. | |
| 4,782,213 A | | 11/1988 | Teal | |
| 4,874,038 A | | 10/1989 | Ehlert | |
| 4,911,234 A | | 3/1990 | Heberer et al. | |
| 4,936,101 A | | 6/1990 | Heberer et al. | |
| D315,404 S | | 3/1991 | Dufour | |
| 5,029,451 A | | 7/1991 | Imaiida et al. | |
| 5,077,825 A | | 12/1991 | Monrose | |
| 5,095,716 A | | 3/1992 | You | |
| 5,097,674 A | | 3/1992 | Imaiida et al. | |
| 5,524,450 A | | 6/1996 | Chen | |
| 5,545,009 A | | 8/1996 | Ke | |
| 5,564,980 A | * | 10/1996 | Becker | 454/252 |
| 5,668,920 A | | 9/1997 | Pelonis | |
| 5,669,229 A | | 9/1997 | Ohbayashi et al. | |
| 5,675,986 A | * | 10/1997 | Chen | 62/426 |
| 5,795,220 A | | 8/1998 | Core | |
| 6,030,287 A | | 2/2000 | Core | |
| 6,160,956 A | * | 12/2000 | Pelonis | 392/361 |
| 6,240,247 B1 | * | 5/2001 | Reiker | 392/364 |
| 6,244,820 B1 | * | 6/2001 | Yilmaz | 416/146 R |

FOREIGN PATENT DOCUMENTS

EP 0 849 543 A1 * 6/1998

* cited by examiner

*Primary Examiner*—Teresa Walberg
*Assistant Examiner*—Vinod D. Patel
(74) *Attorney, Agent, or Firm*—Thorpe North & Western

(57) ABSTRACT

A ceiling fan cooling system comprising an A/C condenser unit, preferably mounted above/beyond the ceiling of a room, and an associated evaporator unit which is mounted in a housing on the inside of the ceiling or flush with the ceiling of the room. The evaporator unit draws room air in and blows it downwardly, over the evaporator coils, toward the blades of a conventional ceiling fan. The air is thus cooled by the evaporator coils and circulated throughout the room by the ceiling fan. The lower surface of the evaporator housing is configured to receive the mounting plate of a conventional off-the-shelf ceiling fan. The system may also be configured as a heating system, for example, using a heat pump or electrical heating elements incorporated into the evaporator housing, allowing the fan to blow air over them.

20 Claims, 4 Drawing Sheets

CEILING FAN COOLING SYSTEM

BACKGROUND OF THE INVENTION

1. Field of the Invention

The present invention relates to cooling and heating systems associated with room ceiling fans. More particularly, the present invention relates to a ceiling-mounted evaporator associated with an air conditioning system, which is configured such that a standard "off-the-shelf" ceiling fan may be mounted to its underside for circulating cooled air throughout a room.

2. State of the Art

During recent years, ceiling fans have enjoyed a resurgence in popularity in the United States, both for their aesthetics and their functionality. In some circumstances where air conditioners could be used, a ceiling fan may adequately circulate room air to increase comfort without the need to actuate a power hungry air conditioning unit. Where heating is desired, ceiling fans can also help recirculate warmer air, which may have risen toward the ceiling, thus helping increase the efficiency of the central heating system.

With increase in popularity of ceiling fans, many design modifications have been developed. For example, specially designed ceiling fans used directly in conjunction with heating and/or cooling systems have been developed. See, for example, U.S. Pat. No. 5,524,450 to Chen, U.S. Pat. No. Des. 315,404 to Dufour, U.S. Pat. No. 4,508,958 to Kan et al., U.S. Pat. No. 5,668,920 to Pelonis, U.S. Pat. No. 5,077,825 to Monrose, U.S. Pat. No. 4,782,213 to Teal, U.S. Pat. No. 5,545,009 to Ke, U.S. Pat. No. 2,638,757 to Borgerd, U.S. Pat. No. 4,702,087 to Nakajima, and U.S. Pat. No. 5,669,229 to Ohbayashi.

OBJECTS AND SUMMARY OF THE INVENTION

However, the prior art does not disclose air cooling or heating systems that may be combined with a conventional, off-the-shelf ceiling fan. The references set forth above as examples of systems which involve a ceiling fan all require a specialized ceiling fan unit. This limits the aesthetic choices for the buyer, and can also greatly increase the price. In particular, it is recognized that it would be advantageous to provide an A/C evaporator or a heating unit which is mounted in a housing which is flush with or mounted on the inside of a room ceiling, the housing having a lower surface that is configured to receive mounting hardware of a conventional off-the-shelf ceiling fan.

It is therefore an object of the present invention to provide an A/C evaporator unit which is mountable on or within the ceiling of a room, having a housing with a lower surface that is configured to receive mounting hardware of a conventional ceiling fan, whereby the ceiling fan may circulate the air cooled by the A/C evaporator.

It is another object of this invention to provide a unit which is mountable on or within the ceiling of a room and configured to receive mounting hardware of a conventional ceiling fan, the unit also incorporating a heating mechanism, whereby the ceiling fan may circulate the air heated by the heating mechanism.

It is yet another object of this invention to provide a unit having a housing with a lower surface that is configured for mounting a conventional ceiling fan, and which includes both cooling and heating mechanisms.

It is yet another object of this invention to provide an air conditioning system associated with a conventional ceiling fan, wherein the evaporator is mountable on or within the ceiling of a room, and the A/C condensor/compressor unit is mountable beyond the ceiling of the room, such as in an attic space or outside the building.

Some of the above objects are realized in a system comprising an A/C condenser unit, preferably mounted above/beyond the ceiling of a room (such as on the roof, within an attic space, or outside the building) and an evaporator unit which is mounted in a housing which communicates with the inside of the room. The evaporator unit and housing may be mounted on the ceiling within the room, or may be mounted in the ceiling of the room, such that the lower surface of the evaporator housing is flush with the ceiling. The lower surface of the evaporator housing is configured to receive the mounting plate of a conventional off-the-shelf ceiling fan. The evaporator unit draws room air in and blows it downwardly, over the evaporator coils, toward the blades of the ceiling fan. The room air may be drawn in through intake vents disposed in the evaporator housing, or may be through an air duct communicating with another part of the room or another room altogether. The air is thus cooled by the evaporator coils and circulated throughout the room by the ceiling fan.

Some of the above objects are also realized in a system as described above, alternately or additionally including a heating mechanism, for example, a heat pump or electrical heating elements incorporated into the evaporator housing. When the heating mechanism is activated, the fan blows air over it, and the ceiling fan helps circulate the warmed air.

Other objects and features of the present invention will be apparent to those skilled in the art, based on the following description, taken in combination with the accompanying drawings.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the appended claims.

Figure 1:
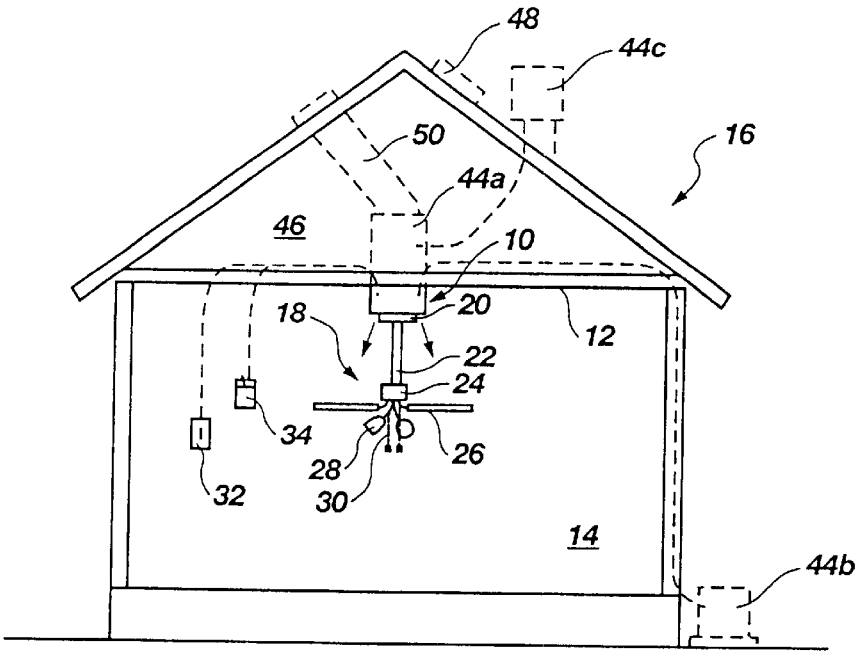
FIG. 1 is a vertical cross-sectional view of a building having a ceiling fan cooling/heating system constructed in accordance with the principles of the present invention installed in a room in the building.
Figure 2A:
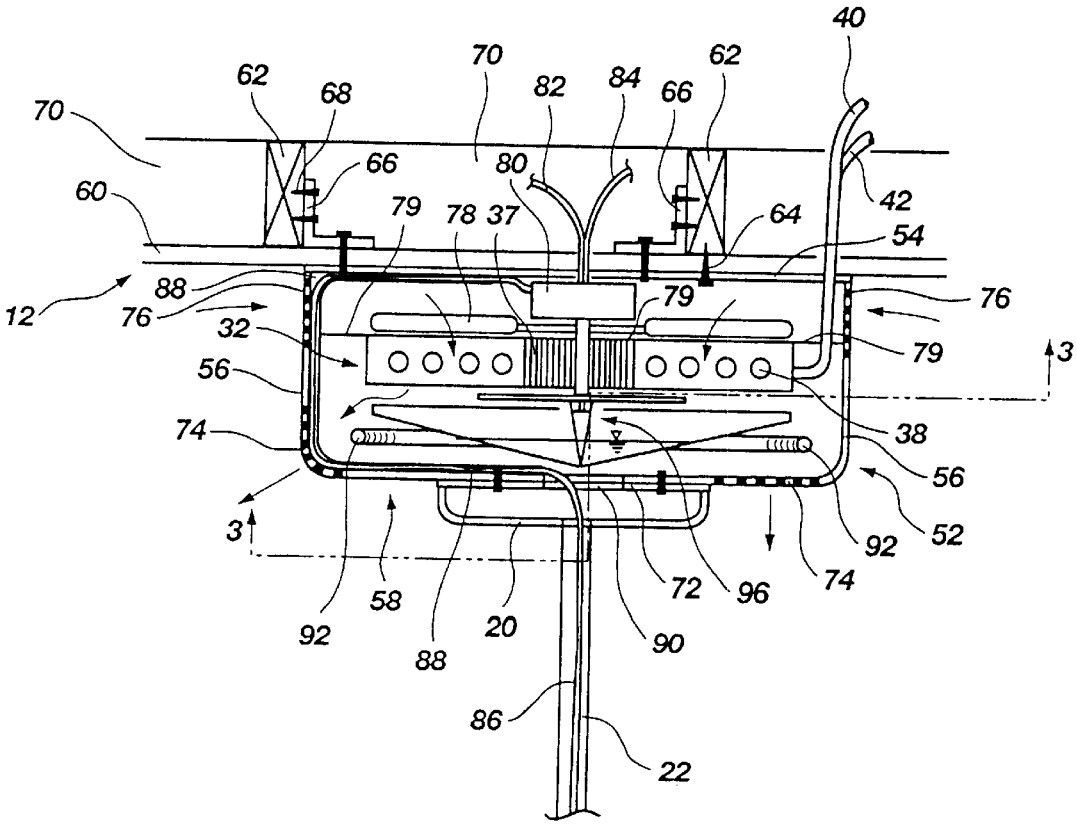
FIG. 2*a* is a vertical cross-sectional view of the ceiling unit of FIG. 1 wherein the ceiling unit is mounted on the inside of the ceiling of the room.

Referring to FIGS. 1 and 2, the present invention comprises a cooling and heating system for use with conventional decorative ceiling fans. The system generally comprises a ceiling unit 10 mounted to the ceiling 12 of a room 14 in a building 16. A conventional decorative ceiling fan 18 is mounted to the lower surface of the ceiling unit. The ceiling fan 18 typically includes a base plate 20, a hollow stem 22, a motor unit 24, and a plurality of blades 26 which are turned by the motor 24 (FIG. 2*a*). The ceiling fan may also have one or more lights 28 for illuminating the room 14, and may have one or more pull chains 30 for allowing activation and control of the fan motor 24 and lights 28. Successive pulls on the pull chains may allow the speed of the ceiling fan to be selectively adjusted through several speeds, and may also allow the lights to be turned on or off, or allow the selection of different illumination levels. Such decorative ceiling fans are widely commercially available in a variety of styles and colors, and are relatively inexpensive. Because the present invention allows the use of these mass-produced ceiling fans, the system as a whole is less expensive than other ceiling fan related cooling/heating systems.

The ceiling unit 10 is an air conditioner/heater which blows cooled or heated air downward toward the ceiling fan. The ceiling unit may be activated and controlled by the pull chains 30, or by a wall switch 32, or a thermostat 34. The switched configuration is particularly useful where the fan is attached to a particularly high ceiling, making pull chains impractical. A pull chain could be used to activate the air conditioning system of the present invention. However, such a pull chain would become entangled in the blades of the ceiling fan if not threaded through the motor unit 24 of the ceiling fan 18. Moreover, while a pull chain could be threaded from the ceiling unit 10, through the hollow stem 22 of the ceiling fan 18, and thence through the center of the ceiling fan motor unit 24 to a point where it could be grasped by a user, this configuration may not be possible with some ceiling fans, and would require modification of the ceiling fan in any event, thus counteracting some of the benefits of the invention. Thus one or more wall switches 32 is preferred.

It will be apparent that multiple switches or multiple/variable position switches may be provided to allow separate control of the components of the system, as desired. Likewise, multiple position switches may be used for multiple stage operation of any or all of these elements. For example, the evaporator fan, A/C unit, and heating elements (described below) may have more than one speed or temperature setting, respectively.

The ceiling unit 10 typically includes an evaporator 36 (FIG. 2*a*) having evaporator coils 38 which are connected by refrigerant lines 40 and 42 to an air conditioning condenser/compressor unit 44 (FIG. 1). The condenser/compressor unit 44 may be mounted in the attic space 46 above the ceiling 12, where it is designated 44*a*, or it may be placed outside the building 16, either on the ground, where it is designated 44*b*, or on the roof, where it is designated 44*c*. It will be apparent that where the attic mounted condenser/compressor unit 44*a* is used, adequate fan-driven vents 48 will be required to prevent excessive heat buildup in the attic space. Alternatively, ductwork 50 may be provided to exhaust hot air directly to the atmosphere outside the roof. This configuration will improve thermal efficiency of the cooling system, while also reducing the possibility of heat damage to the roof structure.

As is understood by those skilled in the art, the air conditioning system functions by pumping condensed refrigerant from the compressor/condenser unit 44 through refrigerant line 40 to the evaporator 36, where the refrigerant passes through an orifice (not shown) and vaporizes within the evaporator coils 38. In so doing, the refrigerant absorbs thermal energy from the evaporator coils, and thence from their surroundings, thus cooling the air around the evaporator. The evaporated refrigerant then flows back to the condenser/compressor unit 44 through refrigerant line 42, where it is again condensed back to liquid form, giving off heat in the process. In this way, thermal energy or heat from the room 14 is transported outside the room, thus cooling the room. The cooled air may then be circulated around the room by the ceiling fan 18. The details of operation of conventional refrigerant-based air conditioning systems are well known by those skilled in the art.

The component parts of the ceiling unit 10 are shown in more detail in FIG. 2*a*. The ceiling unit comprises a housing 52 with a top plate 54, sides 56, and a lower surface 58. The top plate 54 is configured to mount to the ceiling 12 of the room, the ceiling typically comprising drywall 60 attached to truss chords or rafters 62. It will be apparent that the ceiling unit 10 is relatively heavy for a ceiling fixture, and will also experience vibration and temperature variations. Accordingly, the a strong connection is required between the ceiling unit and the truss chords or rafters 62. This connection may comprise direct mechanical attachment of the top plate 54 through the drywall and into the truss chord or rafter 62 using heavy screws or bolts as shown at 64, or may comprise mounting brackets or straps 66 which are securely affixed to one or more chords or rafters 62 via screws, nails, bolts, etc., as shown at 68, and are then affixed to the top plate 54 with screws or bolts. Any connection method which will securely fasten and adequately support the ceiling unit will be sufficient. Cross bracing 70 between the truss chords or rafters may also be installed to help support the ceiling unit and distribute its load throughout the roof structure.

Figure 3:
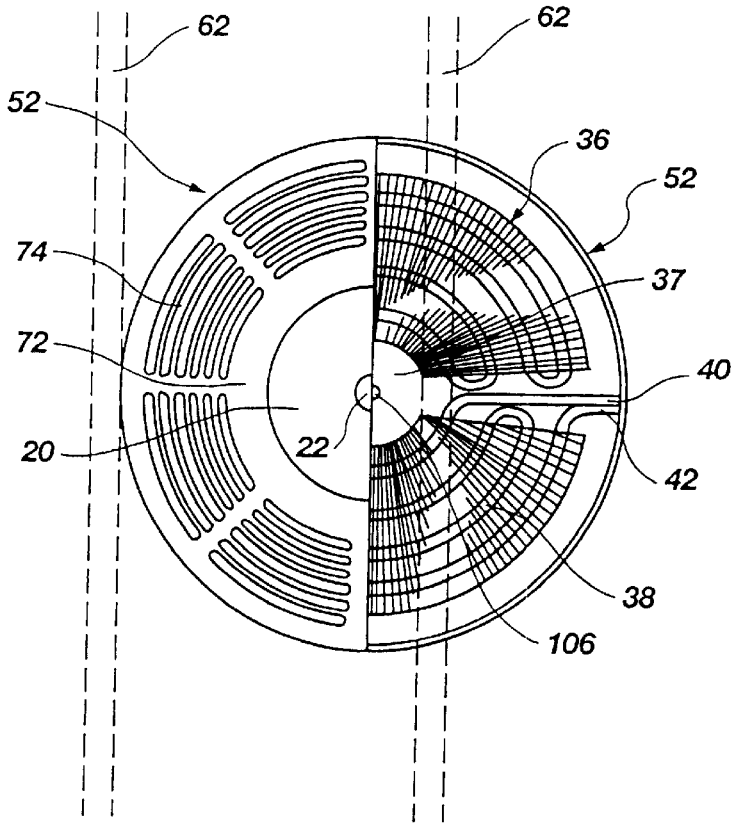
FIG. 3 is a horizontal partial cross-sectional view of the ceiling fan cooling/heating system of FIG. 2*a;*

The lower surface 58 of the housing 52 includes a substantially flat mounting surface 72 for attaching the base plate 20 of the ceiling fan 18, and outlet vents 74 for downward discharge of the cooled or heated air. It will be apparent that the mounting surface 72 may be configured in many different ways to accommodate a wide variety of ceiling fan mounting configurations that exist in the industry. The outlet vents 74 may also be disposed partly or entirely in the sides 56 of the housing, if desired. Also disposed in the sides 56 of the housing near the ceiling 12 are intake vents 76 which allow air to be drawn into the ceiling unit. The ceiling unit is preferably circular in shape, as depicted in the partial sectional view of FIG. 3, with the discharge vents disposed in an annular pattern around the solid lower mounting surface 72. The evaporator 36 is also preferably circular or annular in configuration, and has an opening 37 through its center.

Returning to FIG. 2*a*, an evaporator fan 78, powered by electric motor 80, is configured to draw air in through the intake vents 76, and blow it downwardly, over the evaporator coils 38, toward the outlet vents 74. Baffles 79, preferably formed of sheet metal, are provided around the fan 78 to block passage of air except over the evaporator coils. This reduces blow-by and increases the efficiency of the unit. In this manner, warm air near the ceiling is drawn in, cooled, and discharged downwardly to be circulated throughout the room by the ceiling fan 18. Electrical power for the evaporator fan and the ceiling fan is provided by electrical cables 82, which may be interconnected with switch 32 and thermostat 34 to allow selective activation of the unit. It will also be apparent to those skilled in the art that junction boxes, and other electrical components (not shown) may also be required to meet local building codes. Another electrical cable 84 extends away from the ceiling unit for providing control and possibly activation of the condenser unit 44. It will be apparent that other electrical components, such as a microcontroller, relays, switches, etc. (not shown) will be associated with the ceiling unit 10 to coordinate control of the evaporator fan 78, evaporator 36, condenser 44, and other components of the system. One or more additional electrical cables 86 for providing electrical power to the ceiling fan 18 pass through the housing 52 via conduit 88, through an aperture 90 formed in the mounting surface 72, through the base 20 of the ceiling fan, and downward through the stem 22 of the ceiling fan.

An electro-resistive heating coil 92 may be disposed within the housing 52 near the outlet vents 74, allowing the ceiling unit 10 to alternatively function as a heater. If heating is desired, appropriate controls may be adjusted to send electrical power to the heating coil 92, such that the air blown downward over it from the evaporator fan 78 will be warmed, rather than cooled. Naturally, the ceiling unit will preferably be configured such that the heating coil 92 and evaporator coils 38 cannot operate simultaneously. It will also be apparent that to prevent overheating or fire danger, the unit should be configured such that the heating coil cannot be activated when the evaporator fan 78 is not operating.

Those skilled in the art will recognize that condensation on the evaporator coils 38 can be a problem. Moisture from the air will naturally tend to condense on the evaporator coils, and if not accounted for, will either collect within the housing 52 or drip onto persons or objects below. To deal with this condensation, the present invention incorporates a condensation pan 94, disposed below the evaporator 36 within the housing 52. This pan is configured to catch condensation which drips from the evaporator coils 38, and has the shape of a shallow inverted cone, which directs collected moisture toward the center of the pan. If the ceiling fan cooling unit 10 is used for a brief time only, such that only a relatively small quantity of water collects in the pan 94, this water may simply evaporate over time when the unit is shut off. However, some mechanism and method for disposing of accumulated condensation is preferred, especially if the unit is to be used for longer periods of time.

Figure 2B:
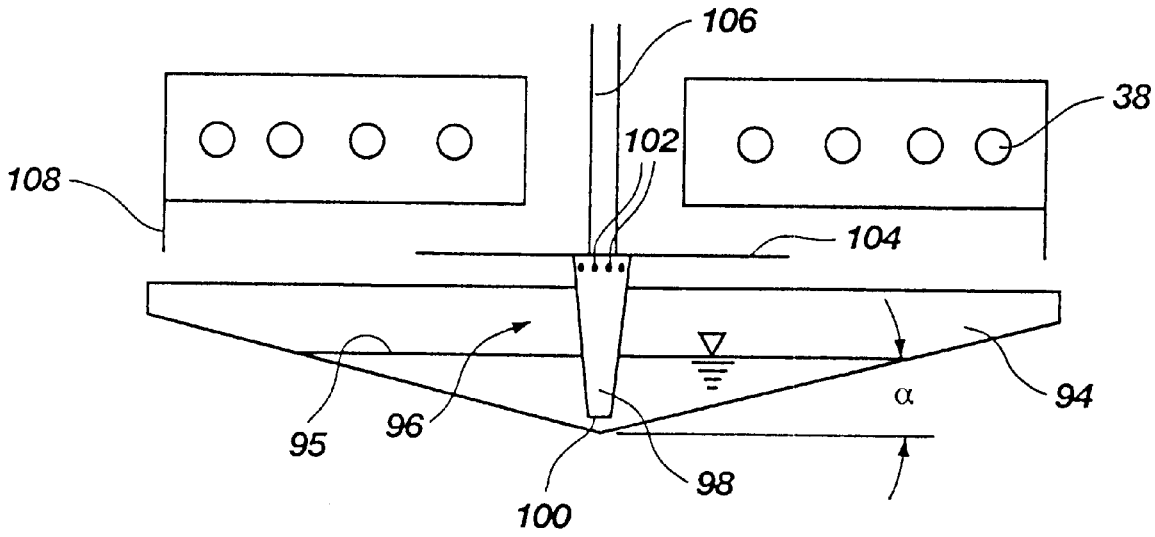
FIG. 2*b* is a partial close-up view of the ceiling unit of FIG. 2*a* showing the condensation pan and condensation dispersing system.

One method of disposing of the accumulated water is to provide a dispersing unit 96, such as is used in common household vaporizers, as shown more clearly in FIG. 2*b*. The dispersing unit 96 generally comprises a steeply tapered inverted cone 98 which has one opening 100 on the bottom, which is configured to be below the water level 95 in the pan 94, and a plurality of openings 102 around its circumference at the top. Attached to the tapered cone near the top openings 102 is a disk 104, and both the tapered cone and disk are affixed to a rotating shaft 106 which descends from the motor 80, through the central opening 37 in the evaporator 36. The shaft 106 rotates the cone very rapidly, causing water at the bottom thereof to begin to rotate simply through friction with the inside of the cone. This rotation of the water induces centripetal acceleration of the water, causing the water to draw up the inside of the cone toward the top openings 102, where the water is flung out along the disk 104. The water is flung off the spinning disk in the form of very small droplets, which may be further reduced in size by a series of vertical fingers 108, which are disposed in a circle around the condensation pan. The shaft 106 may be the same shaft which rotates the evaporator fan, or a gear mechanism (not shown) may be provided between the motor 80 and shaft 106 to ensure that the rotational speeds of the evaporator fan and tapered cone are appropriate for their functioning. The condensation water is thus turned into vapor or mist, which is blown out through the outlet vents 74 with the flowing air. It will be recognized that adding vapor to the cooled air will not result in a change in the relative humidity of the air in the room as a whole because the water which condensed on the evaporator coils 38 originally came from the room air.

The ceiling unit 10 can be mounted on sloping or vaulted ceilings, in addition to the flat ceiling 12 shown in FIG. 1. It will be apparent that one of the primary considerations where sloping ceilings are concerned is to prevent spillage of condensation from the pan 94. If the slope of the ceiling is less than the pan angle a (FIG. 2*a*) of the condensation pan 94, the ceiling unit 10 may be installed without modification. It will be apparent that ceiling units having a variety of angles a may be constructed to accommodate a variety of ceiling slopes.

Figure 4:
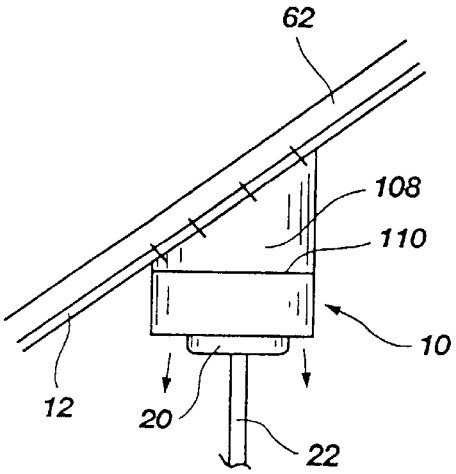
FIG. 4 is an elevation view of the ceiling unit of FIG. 2*a* adapted to mount on a sloped ceiling.

However, if the ceiling slope is greater than $\alpha$, an adapter 108 may be provided for mounting the unit to the ceiling, as shown in FIG. 4. The adapter 108 comprises a sloped top edge, which matches the slope of the ceiling 12 and is affixed thereto, and a horizontal bottom surface 110, to which the ceiling unit 10 is attached. It will be apparent that the adapter 108 may be configured to selectively accommodate a variety of ceiling slopes through modification by the user.

Figure 6:
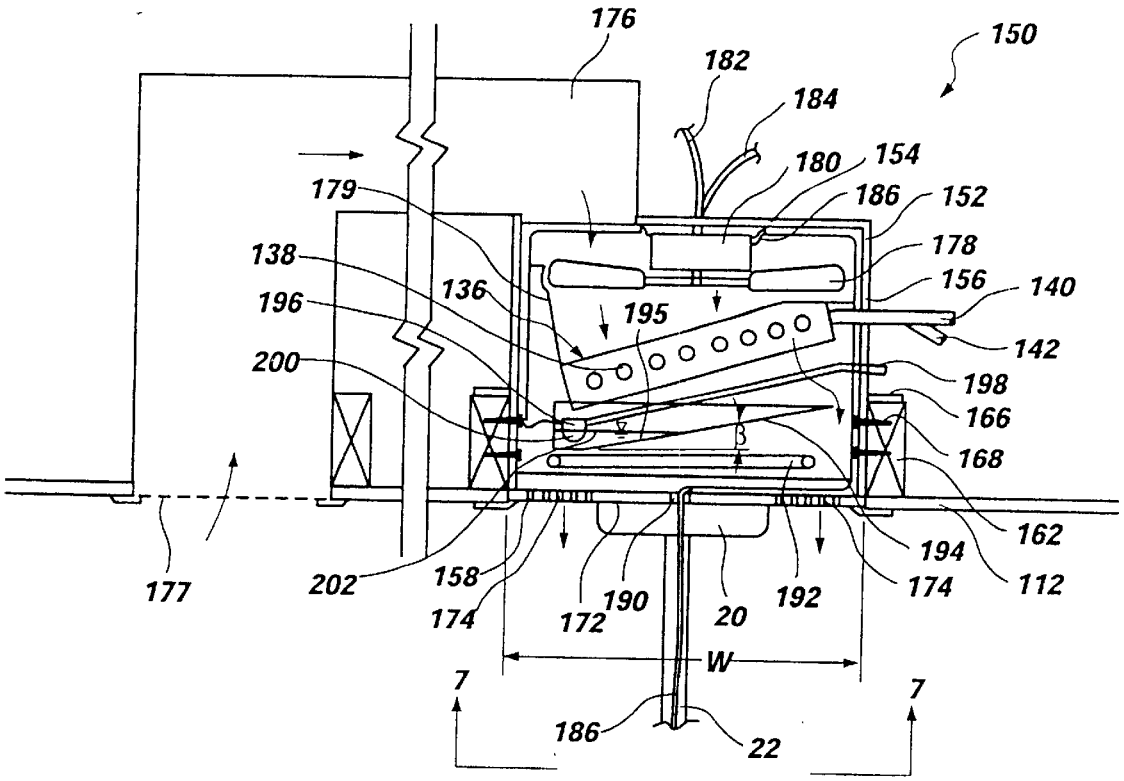
FIG. 6 is a vertical cross-sectional view of an alternative embodiment of the ceiling fan cooling/heating system wherein the lower surface of the ceiling unit is flush with the ceiling of the room.

As an alternative to the embodiment of FIG. 2*a*, the ceiling fan cooling/heating system could be configured such that the lower surface of the ceiling unit is flush with the ceiling of the room, the bulk of the unit being installed in an attic space above the ceiling. This embodiment is depicted in FIG. 6. Like the embodiment of FIG. 2*a*, the flush-mounted ceiling unit 150 comprises a housing 152 with a top 154, sides 156, and a lower surface 158. The sides 156 are configured to mount to the truss chords or rafters 162 with screws, bolts, etc., as shown at 168, such that the lower surface 158 is generally flush with the ceiling 112 of the room. Alternatively, a flange 166 may be provided around the sides of the unit to allow it to sit atop the truss chords or rafters. It will be apparent that to accommodate this installation, the unit 150 preferably has a width w approximately equal to the space between adjacent truss chords or rafters 162, which are frequently disposed at center-to-center spacings of 16" or 24". As with the embodiment of FIG. 2*a*, the ceiling unit 150 is relatively heavy and vibrates. Any connection method which will securely fasten and adequately support the ceiling unit will be sufficient. Cross bracing 170 (FIG. 7) between the truss chords or rafters 162 may also be installed to help support the ceiling unit and distribute its load throughout the roof structure.

The lower surface 158 of the housing 152 includes a substantially flat mounting surface 172, configured to accommodate a variety of ceiling fan mounting configurations that exist in the industry, for attaching the base plate 20 of the ceiling fan 18. The lower surface also includes outlet vents 174 for downward discharge of cooled or heated air.

Unlike the embodiment of FIG. 2*a*, the ceiling unit 150 of FIG. 6 does not include intake vents for drawing in air which communicate directly with the room. Instead, a duct 176 is connected to the top 154 of the housing 152, and directs air from an intake vent 177 disposed some distance from the unit 150, perhaps in another room. It will be apparent that if intake and outlet vents were both provided in the lower surface of the unit, the air which is drawn in would likely include a large quantity of the air which is being discharged, thus placing the unit in a loop which would not effectively cool the air in the room. The configuration of FIG. 6 allows the unit to draw in air from a distant area, thus ensuring that the same air is not recirculated constantly.

Figure 7:
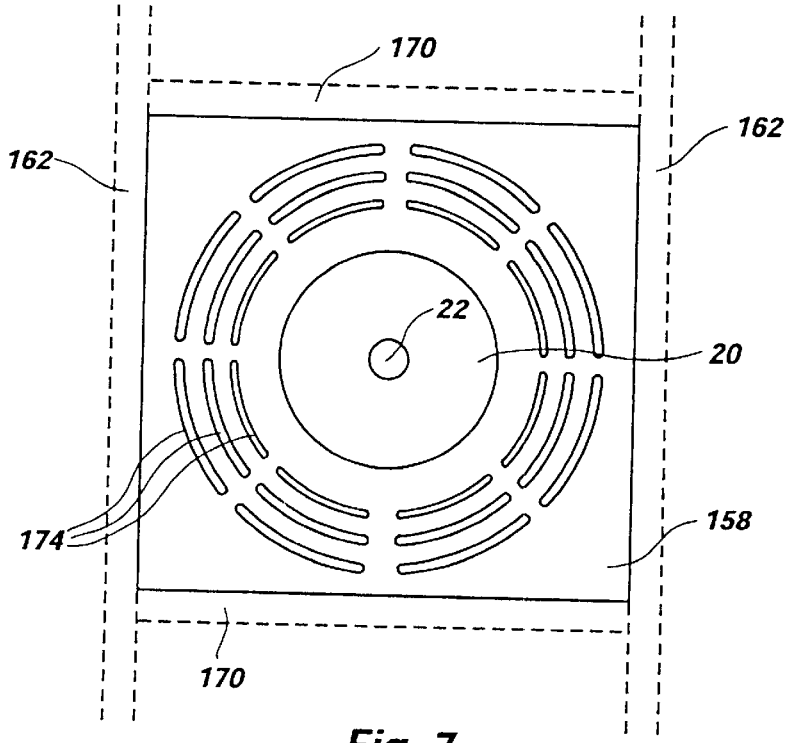
FIG. 7 is a plan view of the lower surface of the ceiling unit of FIG. 6.

As with the embodiment of FIG. 2*a*, the outlet vents of the flush-mounted unit are preferably formed in an annular pattern around the solid lower mounting surface 172 as shown in FIG. 7. However, the ceiling unit 150 and/or its lower surface 158 may be formed in a square shape as shown in FIG. 7, or may have a circular shape similar to that shown in FIG. 3, notwithstanding the actual shape of the housing 152.

The flush-mounted ceiling unit 150 of FIG. 6 includes an evaporator 136 having evaporator coils 138, which are connected by refrigerant lines 140 and 142 to an air conditioning condenser unit (not shown). Unlike the embodiment of FIG. 2*a*, the evaporator 136 is shown rectangular in shape, though a circular or annular evaporator could also be used. An evaporator fan 178, powered by electric motor 180, is configured to draw air in through the intake duct 176, and blow it downwardly, over the evaporator coils 138, toward the outlet vents 174. Baffles 179, preferably formed of sheet metal, are provided around the fan 178 to block passage of except over the evaporator coils. This reduces blow-by and increases the efficiency of the unit. Electrical power for the evaporator fan and the ceiling fan is provided by electrical cables 182, which may be interconnected with the switch 32 and thermostat 34 (FIG. 1) to allow selective activation of the unit. Another electrical cable 184 extends away from the ceiling unit for providing control of the condenser unit. It will be apparent that other electrical components, such as a microcontroller, relays, switches, junction boxes, etc. (not shown) will be needed in association with the ceiling unit 150 to allow control of the various components of the system. One or more additional electrical cables 186 for providing electrical power to the ceiling fan 18 pass through the housing 152 via conduit 188, through an aperture 190 formed in the mounting surface 172, through the base 20 of the ceiling fan, and downward through the stem 22 of the ceiling fan.

As with the embodiment of FIG. 2*a*, some method of collecting and eliminating condensation is needed. In the embodiment of FIG. 6, a condensation pan 194, disposed below the evaporator 136 within the housing 152, is configured to catch condensation which drips from the evaporator coils 138. The condensation pan 194 has a sloping bottom, which is sloped in the same direction as the evaporator coils 138, collected moisture is directed toward the deep end of the pan, where a small pump 196 is disposed with its inlet below the water level 195 in the pan 194. The pump is preferably a small electric pump, which pumps condensation water through a condensation conduit 98 to a suitable discharge point (not shown),preferably outside the building. The pump may include electrodes 100 and 102 for sensing the presence and level of water, for activating the pump only when needed to prevent overflow of the pan 194. It will be apparent that the flush-mounted ceiling unit 150 may be configured to incorporate the condensation elimination system of the embodiment of FIG. 2*a*, and vice versa.

Figure 5:
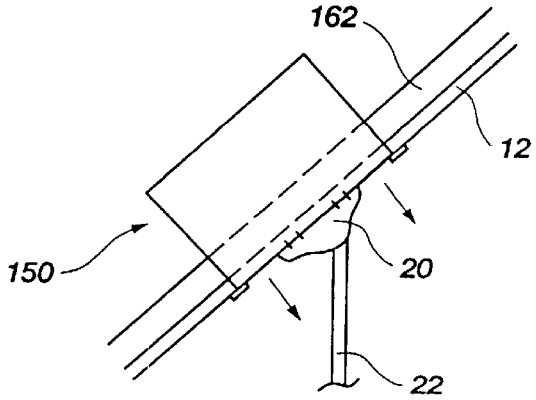
FIG. 5 is an elevation view of the ceiling unit of FIG. 6 adapted to mount on a sloped ceiling.

The flush-mounted ceiling unit 150 can also be mounted on sloping or vaulted ceilings, as shown in FIG. 5. The condensation pan 194 has slope angle β (FIG. 6). If the slope of the ceiling is less than β, the ceiling unit 10 may be installed without modification. However, unlike the embodiment of FIG. 2*a*, with the embodiment of FIG. 6, condensation pans having steeper angles β will be required to accommodate steeper ceiling slopes.

As with the embodiment of FIG. 2*a*, an electro-resistive heating coil 192 may be disposed within the housing 152 near the outlet vents 174, allowing the ceiling unit 150 to alternatively function as a heater. If heating is desired, appropriate controls may be adjusted to send electrical power to the heating coil 192, such that the air blown downward over it from the evaporator fan 178 will be warmed, rather than cooled. Naturally, the ceiling unit will preferably be configured such that the heating coil 192 and evaporator coils 138 cannot operate simultaneously. It will be apparent that to prevent overheating or fire danger, the unit should be configured such that the heating coil cannot be activated when the evaporator fan 178 is not operating.

As an alternative to the electro-resistive heating system described, the ceiling unit could be provided with a heat pump (not shown), rather than a refrigerant based air conditioning system, so as to selectively allow heating or cooling. Such heat pump systems are well known, and are reversible to allow thermal energy to be transported either direction. Thus, on a hot day, the system can be run in a first direction to draw heat away from a room an to the outside, and on a cold day can be used to draw heat into the room from the outside. Other comparable configurations for heating air could also be devised by those skilled in the art, and incorporated into the ceiling mounted unit.

The invention is thus configured to cool or heat air above the ceiling fan 18, and then allow the rotating ceiling fan to circulate the air throughout the room 14. Alternatively, if a reversible ceiling fan is used, the ceiling fan 18 may be reversed in its rotation to force the air which is discharged from the ceiling unit outward against the ceiling 12, thus causing the cooled or heated air to circulate throughout the room. This approach may be particularly appropriate for use in the cooling mode, given that cooler air is more dense and naturally sinks toward the floor.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A ceiling fan cooling system comprising:

an evaporator associated with an air conditioning system, said evaporator being mounted adjacent to the ceiling of a room in a building, and comprising:

evaporator coils for cooling air therearound; and a housing having a lower surface with a substantially flat face configured to support a conventional ceiling fan that is configured to mount to a room ceiling.

2. The ceiling fan cooling system of claim 1, further comprising a conventional ceiling fan mounted to the lower surface of the housing, whereby air cooled by the evaporator may be circulated throughout the room by the ceiling fan.

3. The ceiling fan cooling system of claim 1, further comprising an air conditioning condenser associated with the evaporator, and disposed beyond the ceiling of the room.

4. The ceiling fan cooling system of claim 3, wherein the air conditioning condenser is disposed within an attic space above the room.

5. The ceiling fan cooling system of claim 3, wherein the air conditioning condenser is disposed outside the building.

6. The ceiling fan cooling system of claim 1, further comprising:

an evaporator fan disposed within the housing above the evaporator for blowing air downwardly over the evaporator coils; and a plurality of outlet vents disposed in the lower surface of the housing for allowing said air to flow downward into the room.

7. The ceiling fan cooling system of claim 6, further comprising:

an air inlet disposed at a location remote from the housing;

an air duct connected to the air inlet and to a top of the housing above the evaporator fan, for allowing air to be drawn into the housing by the evaporator fan.

8. The ceiling fan cooling system of claim 6, further comprising:

the housing having sides and a top surface which is mounted to the room ceiling;

air inlets disposed in the sides of the housing around the perimeter thereof near the top surface; and wherein the evaporator fan is configured to draw air from the room near the ceiling through the air inlets, and force said air downwardly, over the evaporator coils, and through the air outlets.

9. The ceiling fan cooling system of claim 1, further comprising an aperture formed in the lower surface of the housing, for accommodating the passage through the housing of electrical chords associated with the ceiling fan.

10. The ceiling fan cooling system of claim 9, further comprising a wall switch for selectively controlling operation of the air conditioning system associated with the evaporator.

11. The ceiling fan cooling system of claim 1, further comprising heating means disposed within the housing.

12. The ceiling fan cooling system of claim 11, wherein the heating comprises an electro-resistive heating element.

13. An evaporator unit associated with an air conditioning system and mountable adjacent the ceiling of a room in a building, comprising:

evaporator coils associated with the air conditioning system;

an evaporator fan for blowing air over the evaporator coils;

a housing for containing the evaporator and the evaporator fan, said housing having a lower surface with a substantially flat face configured to receive the mounting hardware of a conventional ceiling fan, and having outlet vents disposed toward the lower surface generally surrounding the flat face; and wherein the evaporator fan is configured to force air downwardly over the evaporator coils, and through the outlet vents.

14. The evaporator unit of claim 13, wherein an air conditioning condenser associated with the air conditioning system is disposed beyond the ceiling of the room.

15. The evaporator unit of claim 13, wherein the air conditioning condenser is disposed in a location selected from an attic space above the room, and outside the building.

16. The evaporator unit of claim 13, further comprising an electro-resistive heating element disposed within the housing above the outlet vents.

17. The evaporator unit of claim 16, further comprising air inlets disposed above the evaporator fan for allowing intake of air, said air inlets selected from the group consisting of an air duct connected to the air inlet and to a top of the housing above the evaporator fan for drawing air from a location remote from the housing, and air inlets disposed in sides of the housing near a top surface thereof, the top surface being mounted to the room ceiling.

18. The evaporator unit of claim 16, further comprising:

an aperture formed in the lower surface of the housing for allowing passage of electrical chords associated with the ceiling fan; and a wall switch for selectively controlling operation of the air conditioning system, the heating means, and the evaporator fan.

19. The evaporator unit of claim 13, further comprising a conventional ceiling fan mounted to the lower surface of the housing, whereby air cooled by the evaporator may be circulated throughout the room by the ceiling fan.

20. A ceiling fan heating/cooling system comprising:

an air conditioning condenser disposed outside a room having a ceiling;

an evaporator associated with the air conditioning condenser, said evaporator having evaporator coils and being mountable to the ceiling of the room;

heating means disposed adjacent the evaporator;

an evaporator fan for blowing air over the evaporator coils and the heating means;

a housing mountable adjacent to the ceiling and configured for containing the evaporator, the heating means, and the evaporator fan; and a conventional ceiling fan mounted to a lower surface of the housing, whereby air cooled by the evaporator or heated by the heating means is forced downwardly toward the ceiling fan by the evaporator fan, such that the cooled or heated air may be circulated throughout the room by the ceiling fan.

* * * * *